US005494175A

United States Patent [19]

Higdon et al.

[11] Patent Number: 5,494,175

[45] Date of Patent: Feb. 27, 1996

[54] HANGING FILE SUPPORT STRUCTURE FOR A DRAWER

[75] Inventors: Dale Higdon, Davenport; Kirk Petersen, Muscatine, both of Iowa

[73] Assignee: Hon Industries Inc., Muscatine, Iowa

[21] Appl. No.: 287,270

[22] Filed: Aug. 8, 1994

[51] Int. Cl.[6] ..... A47F 7/16

[52] U.S. Cl. ..... 211/46; 312/184

[58] Field of Search ..... 211/46, 182, 189; 312/184; 220/4 R, 22.1

[56] References Cited

U.S. PATENT DOCUMENTS

| | | | |
|---|---|---|---|
| 2,336,802 | 12/1943 | Posner | 211/46 |
| 2,925,086 | 2/1960 | Stark | 312/184 |
| 3,547,300 | 12/1970 | Studinski et al. . | |
| 3,647,101 | 3/1972 | Hensch et al. . | |
| 3,748,008 | 7/1973 | Pryor | 312/184 |
| 3,944,080 | 3/1976 | Hansen . | |
| 3,999,663 | 12/1976 | Walter | 211/46 |
| 4,030,610 | 6/1977 | Alexander | 211/182 |
| 4,475,657 | 10/1984 | Albery | 312/184 X |
| 4,478,657 | 10/1984 | Albery . | |
| 4,601,398 | 7/1986 | Solomon . | |
| 4,726,635 | 2/1988 | Rariden | 312/184 |
| 4,869,563 | 9/1989 | Willer . | |
| 5,111,941 | 5/1992 | Hillestad . | |
| 5,255,798 | 10/1993 | Aaldenberg et al. . | |
| 5,358,126 | 10/1994 | Jones | 211/46 |
| 5,396,995 | 3/1995 | Iurek | 211/46 |

FOREIGN PATENT DOCUMENTS

| | | | |
|---|---|---|---|
| 518582 | 11/1955 | Canada | 312/184 |
| 1044442 | 11/1953 | France | 211/46 |

*Primary Examiner*—J. Franklin Foss

*Attorney, Agent, or Firm*—Jones, Day, Reavis & Pogue

[57] ABSTRACT

A hanging file support structure for the drawer of a file cabinet comprises a hangrail and a bracket for supporting the hangrail in a generally horizontal position within the drawer. The bracket is generally C-shaped in cross-section and has pairs of hooks extended from edges thereof which are received in slots provided in a wall of the drawer. Two sets of slots are provided in the wall of the drawer such that the bracket may selectively be supported in either of two positions thereby defining two separate positions for the hangrail to accommodate hanging file folders of different widths.

7 Claims, 4 Drawing Sheets

HANGING FILE SUPPORT STRUCTURE FOR A DRAWER

BACKGROUND OF THE INVENTION

1. Field of the Invention

The present invention relates generally to a hanging file support structure for a cabinet drawer and it relates, more particularly, to a support structure which is conveniently adjustable within the drawer to accommodate hanging file folders of differing width.

2. Description of the Prior Art

A commonly used file cabinet has drawers which are equipped with racks for suspending hanging file folders. Hanging file folders have long been popular because they allow for the neat arrangement of files in an upright erect disposition within the file drawer without the need for a back-up support structure. Various types of racks for hanging file folders are known. However, it is desirable that the racks be adjustable to accommodate hanging file folders of differing width. To this end, Figueroa U.S. Pat. No. 4,234,238 teaches a file drawer having rails for supporting adjustable track members which may be positioned to a desired width thereby accommodating file folders of differing dimensions. However, a disadvantage of the foregoing system is that the track members do not positively lock to the rails and, therefore, they can be jarred out of width adjustment. Accordingly, it is desirable to provide a hang rail system which is sturdy in construction and can be positively preadjusted to a desired file width.

It is also known to provide a separate frame for placement within a file drawer to hang file folders. An exemplary frame is disclosed in Walter et al., U.S. Pat. No. 3,999,663 wherein the width of the frame is predetermined by adjustment of telescoping cross members. However, it is desirable to provide a hanging file support system which is essentially designed into the drawer without the need for auxiliary frame structure.

SUMMARY OF THE INVENTION

The present invention provides a hanging file support structure for the drawer of a cabinet comprising a hangrail and a bracket for supporting the hangrail in a generally horizontal position within the drawer. The bracket is generally C-shaped in cross-section and has pairs of hooks which are received in slots provided in a wall of the drawer. Two sets of slots are provided in the wall of the drawer such that the bracket may selectively be supported in either of two positions thereby defining two separate positions for the hangrail to accommodate hanging file folders of differing widths.

BRIEF DESCRIPTION OF THE DRAWINGS

The foregoing and other novel features of the present invention will be better understood by a reading of the following detailed description taken in connection with the accompanying drawings wherein.

DETAILED DESCRIPTION OF THE PREFERRED EMBODIMENTS

Figure 1:
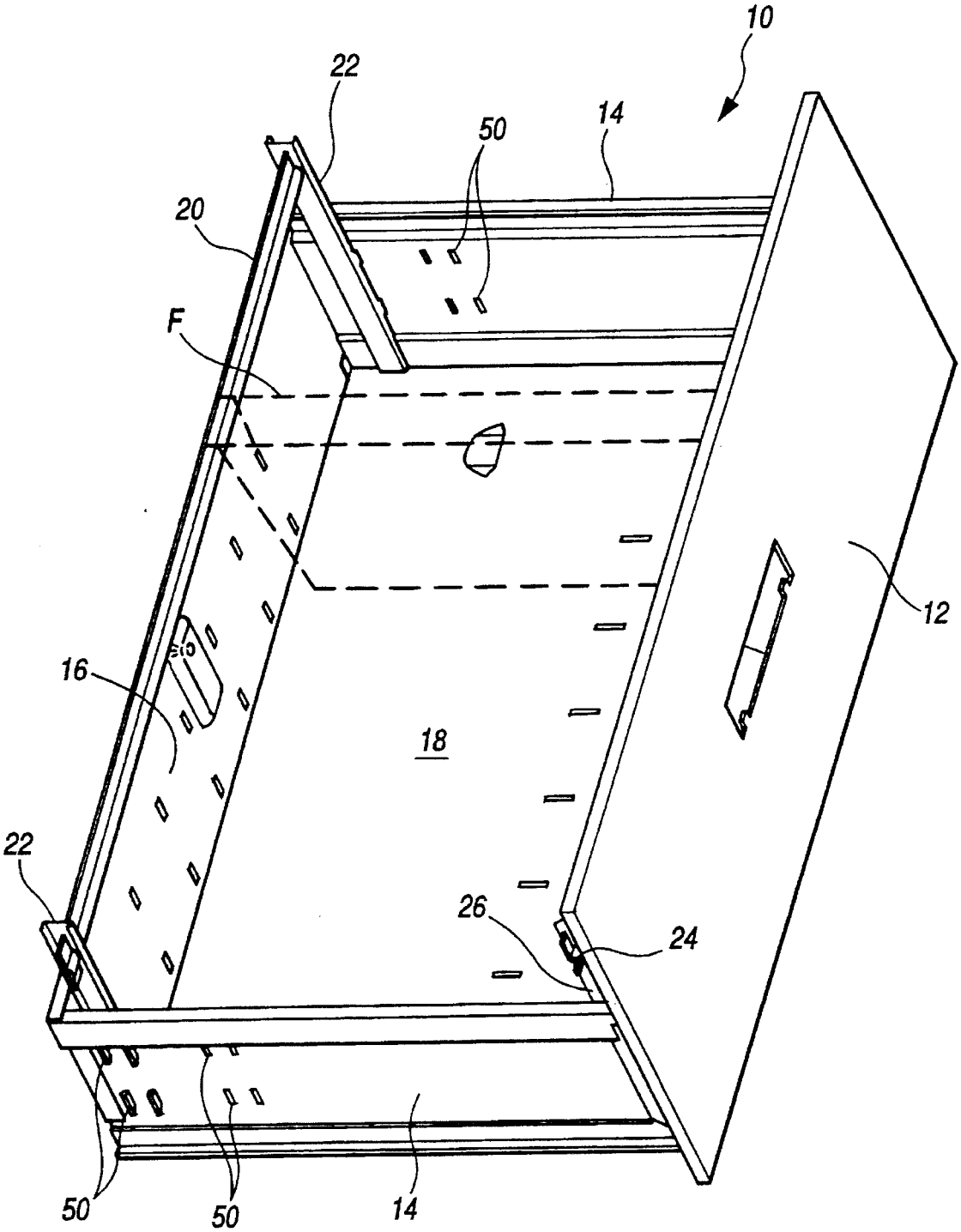
FIG. 1 is a top perspective view of a lateral file cabinet drawer having a file hangrail structure in accordance with the invention.

Referring now to the drawings, and initially to FIG. 1, there is illustrated a file cabinet drawer of the lateral file type, designated generally by the reference numeral 10. The drawer 10 is preferably fabricated from sheet steel and includes a front 12, a pair of side walls 14, a rear wall 16 and a bottom 18. In accordance with the invention, the drawer 10 is provided with a rear hangrail 20 for supporting a hanging file folder, shown in phantom as F. The hangrail 20 is suspended from a pair of hangrail brackets 22 in a manner which will be described in detail hereinafter. A forward hangrail 24, only the end of which can be seen, is fabricated identical to the rear hangrail 20 and is suspended in a suitable pair of cut-outs provided in rearwardly extending flanges 26 of the drawer front 12.

Figure 2:
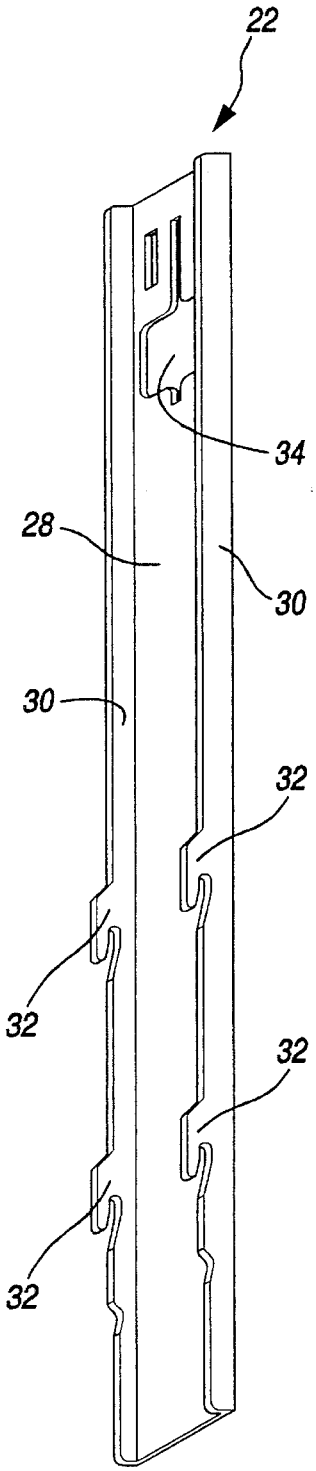
FIG. 2 is a perspective view of a hangrail bracket constructed in accordance with the invention.
Figure 3:
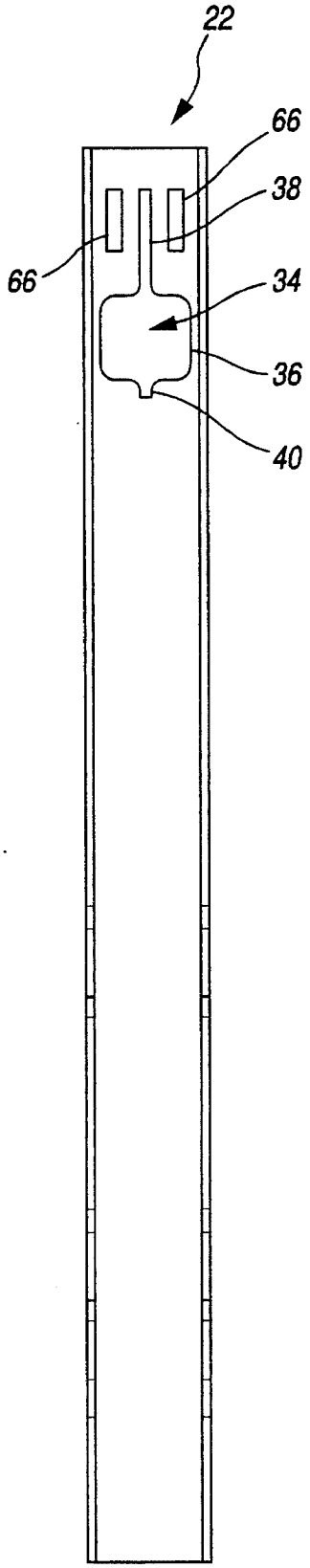
FIG. 3 is a rear elevational view of the hangrail bracket.
Figure 4:
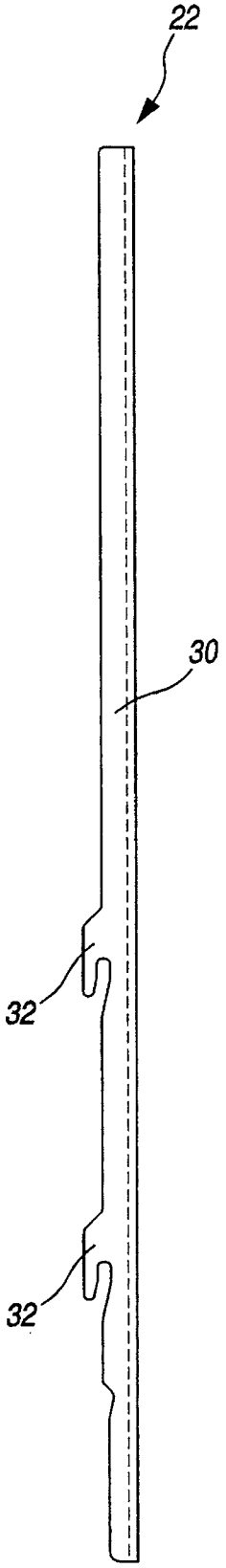
FIG. 4 is a side elevational view of the hangrail bracket.

The hangrail bracket 22 is best seen in FIGS. 2, 3 and 4 and comprises a generally C-shaped channel member with a central web 28 and two rearwardly projecting legs 30. Projecting from the legs 30 are pairs of integrally formed hooks 32. In order to support the hangrail 20, the bracket 22 includes a cut-out 34 formed in the shape of a central square region 36 with a vertical slot 38 and a lower notch 40.

Figure 5:
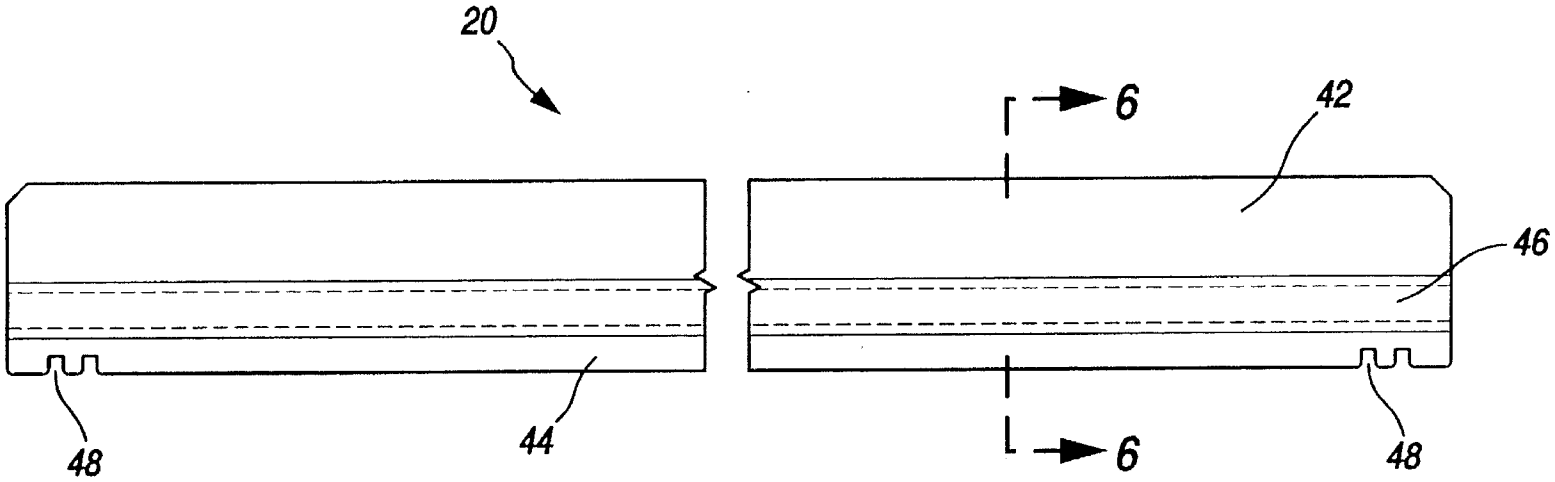
FIG. 5 is a plan view of a hangrail in accordance with the invention.
Figure 6:
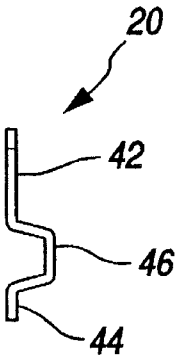
FIG. 6 is a cross-sectional view of the hangrail taken substantially along the line 6—6 of FIG. 5.

The hangrail 20 is illustrated in FIGS. 5 and 6 and consists of a general elongate member having a wide flange portion 42 and a narrow flange portion 44 with a central reinforcing channel 46. Notches 48 are provided at the ends of the hangrail which cooperate with the notches 40 of the brackets 22 to position the hangrail 20 within the bracket cut-outs 34. The notches 48 provided at both ends of the hangrail 20 engage either the notches 40 of the brackets 22 or notches provided in the flanges 26 of the drawer front 12. This allows for a universal hangrail 20 which can be used in both the front and rear of the drawer 10. The wide flange portion 42 of the hangrail 20 and vertical slot 38 of the bracket 22 serve to positively resist torsional loads of hanging file folders.

In accordance with the invention and as best seen in FIG. 1, pairs of slots 50 are provided in the side walls 14 of the drawer 10. The slots 50 are spaced and dimensioned to be in registry with the hooks 32 of the brackets 22 such that the hooks 32 of the brackets 22 can be inserted into the slots 50 and the brackets 22 can be supported firmly in an upright position on the walls 14 of the drawer 10. In order to accommodate file folders of differing widths, such as both legal and letter sized files, two sets of slots 50 are provided in suitably spaced relation. The rear hangrail 20 can thereby be installed in two discrete positions within the drawer 10.

Figure 7:
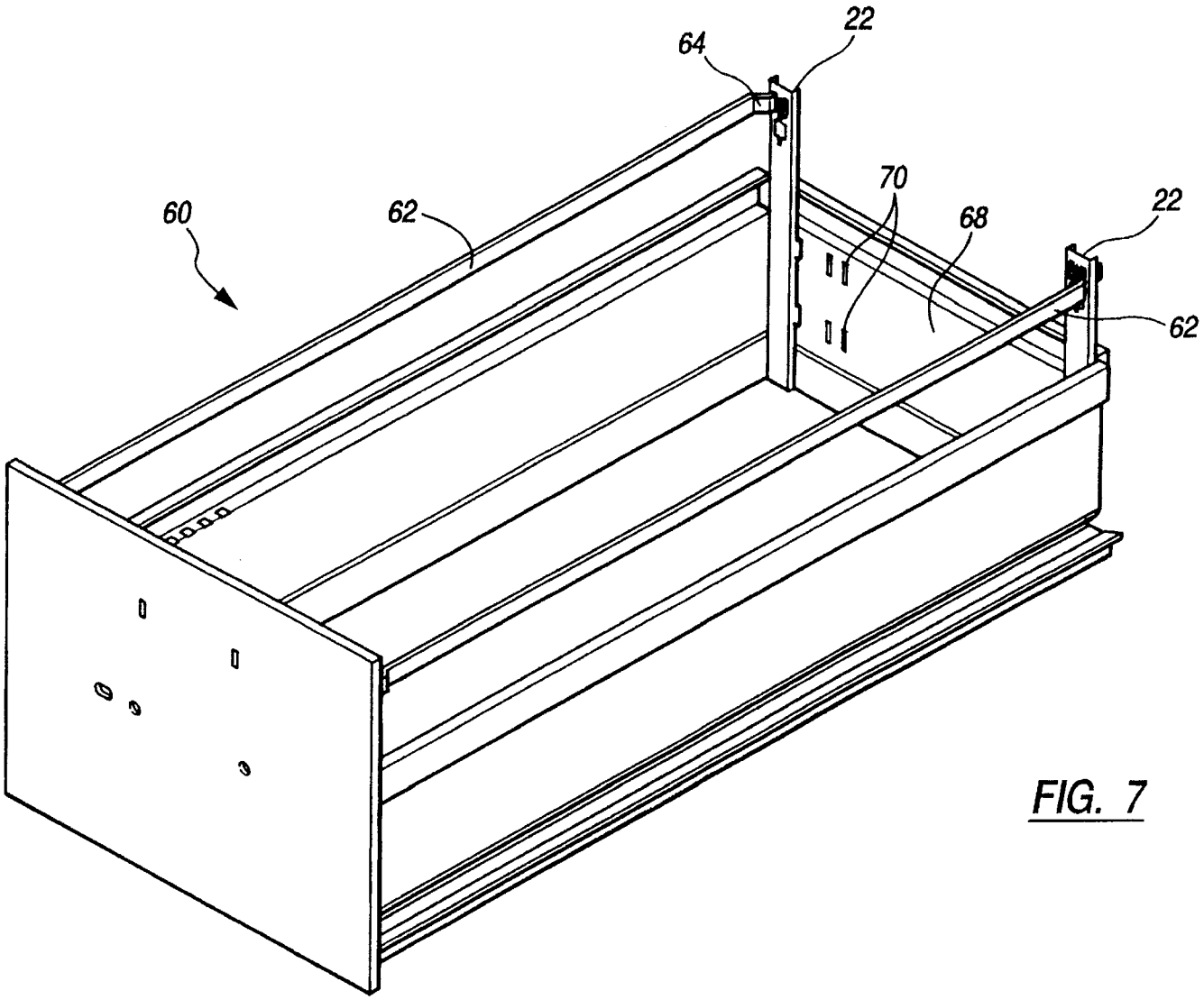
FIG. 7 is a cross-sectional view of a second embodiment of the invention illustrating the present hangrail structure as used in a vertical file cabinet drawer.

Turning now to FIG. 7, a second embodiment of the invention is illustrated in the form of a vertical file cabinet drawer 60. In this embodiment, the hangrail brackets 22 support modified hangrails 62 comprising bars with offset ends 64. The offset ends 64 serve to increase the effective spacing of the hangrails 62 such that the drawer can accommodate large files with the brackets 22 set inboard of the drawer side walls. As best seen in FIG. 3, the handrails 62 are supported within slots 66 formed in the upper ends of the brackets 22. As in the embodiment of FIG. 1, the drawer 60 has a rear wall 68 provided with sets of slots 70 which can be used alternatively to locate one hangrail in either of two positions. File folders of differing widths can thereby be accommodated by the drawer 60.

It can now be appreciated that the brackets 22 of the present invention provide a highly effective and easily manufactured means for adjusting a file cabinet drawer to alternatively hold different size hanging file folders. Because the bracket is made with both the cut-out 34 and slots 66, it is adaptable for use in either lateral or vertical file cabinets, thus saving on manufacturing costs.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A hanging file support structure for the drawer of a cabinet, wherein the drawer is formed with a front wall, a back wall and two connecting side walls, comprising:

a generally elongate hangrail for suspending hanging file folders;

a bracket having means engagable with said hangrail for supporting said hangrail in a generally horizontal position, said bracket having at least one pair of hooks formed thereon, and at least two pairs of slots provided in a wall of said drawer, said pairs of slots being spaced laterally from one another to define two discrete widths along said wall and said slots being dimensioned and configured to receive said hooks of said bracket;

wherein said brackets are alternatively receivable in said pairs of slots to position said hangrail within said drawer for alternatively hanging files of differing widths.

2. The support structure of claim 1 wherein said bracket is generally C-shaped in cross-section.

3. The support structure of claim 1 wherein said hangrail is generally elongate with a reinforcing rib extending substantially the length thereof.

4. The support structure of claim 1 wherein said pairs of slots are formed in a side wall of said drawer.

5. The support structure of claim 1 wherein said pairs of slots are provided in the rear wall of said drawer.

6. The support structure of claim 1 wherein said bracket means engagable with said hangrail includes a cut-out in said bracket in which said hangrail is received.

7. The support structure of claim 2 wherein said C-shaped cross-section defines a web with two laterally extending legs and said hooks project one from each leg.

* * * * *